United States Patent [19]

Seager et al.

[11] Patent Number: 4,744,494

[45] Date of Patent: May 17, 1988

[54] RAM GUN

[75] Inventors: Richard H. Seager, Mystic; Philip B. Hinkle, W. Hartford, both of Conn.

[73] Assignee: Calumet Manufacturing Co., E. Orange, N.J.

[21] Appl. No.: 936,176

[22] Filed: Dec. 1, 1986

[51] Int. Cl.[4] ..... B67D 5/42

[52] U.S. Cl. ..... 222/391; 16/112; 16/225; 16/DIG. 13; 74/141.5; 74/169; 222/323; 222/326; 604/224

[58] Field of Search ..... 222/325–327, 222/323, 391; 604/209, 210, 223, 224; 73/864.13, 864.14, 864.16, 864.18; 74/141.5, 169; 16/112, 225, DIG. 13

[56] References Cited

U.S. PATENT DOCUMENTS

| | | | |
|---|---|---|---|
| 2,884,877 | 5/1959 | Nalbone et al. | 222/391 |
| 3,110,310 | 11/1963 | Cislak | 604/209 |
| 3,517,668 | 6/1970 | Brickson | 222/391 X |
| 3,823,447 | 7/1974 | Johnson | 16/DIG. 13 X |
| 4,014,331 | 3/1977 | Head | 604/223 X |
| 4,099,548 | 7/1978 | Sturm et al. | 222/391 X |
| 4,261,486 | 4/1981 | Bush et al. | 16/225 X |
| 4,456,450 | 6/1984 | Heling | 222/391 X |
| 4,503,991 | 3/1985 | Joyce | 16/225 X |
| 4,641,766 | 2/1987 | Vlasich | 222/391 |

FOREIGN PATENT DOCUMENTS

| | | | |
|---|---|---|---|
| 2469175 | 5/1981 | France | 604/209 |

*Primary Examiner*—Kevin P. Shaver

*Attorney, Agent, or Firm*—St. Onge Steward Johnston & Reens

[57] ABSTRACT

A ram gun for dispensing viscous fluid products such as adhesive, caulking materials and the like is disclosed. The gun can be rechargeable or can be employed as a single charge, disposable device. In a particular embodiment, the gun is formed in two parts by molding from plastic material. One part comprises the ram. The other comprises a container section for the material to be dispensed and is provided with integrally formed nozzle, handle and trigger. The trigger has an integrally formed pawl. The trigger is attached to the handle by a thin plastic strip acting as a living hinge and biasing the trigger away from the handle. The ram is slidably mounted in the container section and is incrementally advanced therein by operation of the pawl and rack which is actuated by squeezing of the handle and trigger. Optionally, the distance which the trigger can travel between the actuating and non-actuating positions is limited, for example, by hooks on the handle or trigger which slidably engage corresponding lugs on the other of the handle or trigger.

13 Claims, 3 Drawing Sheets

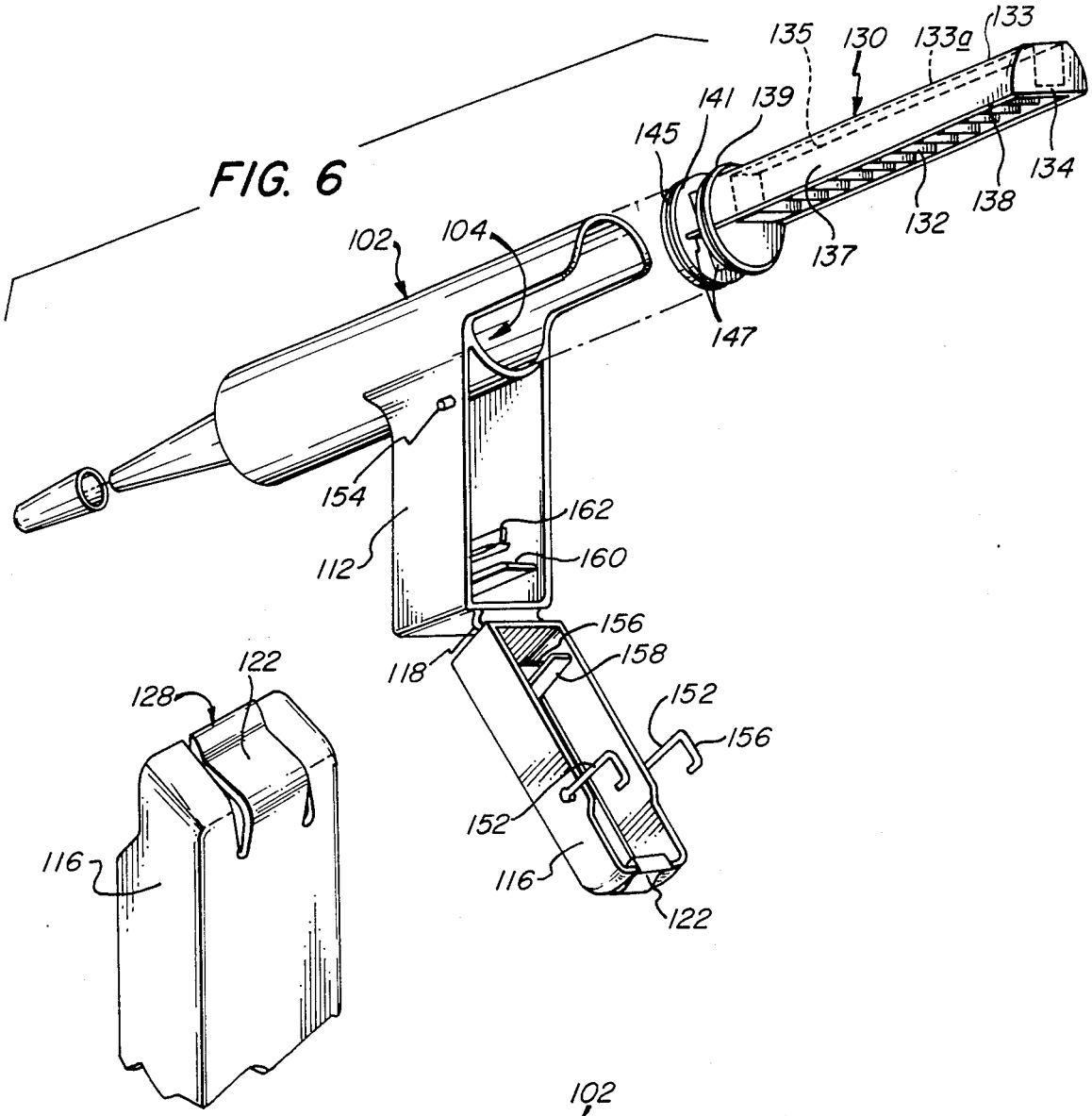
FIG. 6
FIG. 7
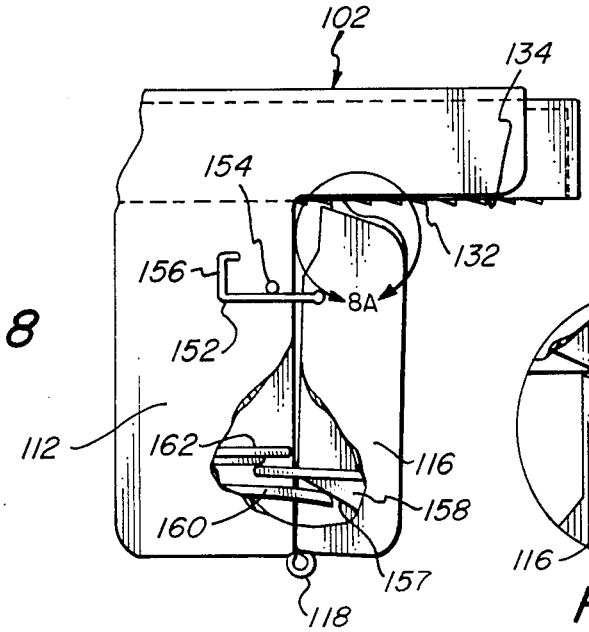
FIG. 8
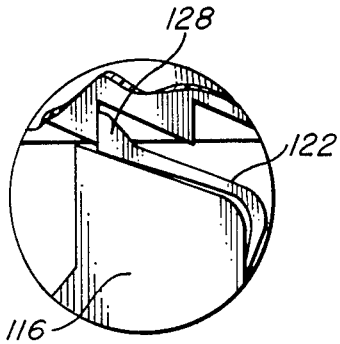
FIG. 8A

RAM GUN

BACKGROUND OF THE INVENTION

This invention relates to a novel dispenser for a viscous fluid materials and is more particularly concerned with a ratchet driven ram gun of novel construction.

DESCRIPTION OF THE PRIOR ART

Ram gun dispensing devices actuated by a pawl and ratchet mechanism are well-known in the art. Illustratively, Taylor et al. U.S. Pat. No. 1,997,129 shows a gun for dispensing lubricants and having a piston assembly actuated by a rack and pawl. Sherbondy U.S. Pat. No. 076,225 shows a ratchet driven cartridge type caulking gun.

Mapel et al. U.S. Pat. No. 3,141,583 describes an injection gun for dispensing doses of liquid veterinary medicines and the like from cartridges and having a trigger-like mechanism for actuating the ratchet-drive which operates the gun. Wild U.S. Pat. No. 3,750,913 shows a device for dispensing solid foods such as butter and having a barrel with a ratchet-operated plunger. Hicks U.S. Pat. No. 3,920,156 shows a similar device also equipped with a ratchet operated piston.

Sturm et al. U.S. Pat. No. 4,099,548 describes as hand held pipette for dispensing measured quantities of liquid and having a piston and cylinder assembly with an internal pawl and rack mechanism, actuated by pressure on a knob, for advancing the piston.

Hamilton U.S. Pat. No. 4,318,499 shows a cartridge type caulking gun having a flexible ratchet drive mechanism which is retained in a curved track within the handle of the gun.

Sartain U.S. Pat. No. 4,323,176 discloses a free-standing dispenser for foodstuffs and having a piston driven by a lever operated spring type ratchet.

The ram guns previously described in the art, particularly those designed to dispense viscous fluid materials such as sealants, adhesives, caulking compositions and the like, are generally characterized by a plurality of components each of which has to be fabricated independently prior to assembly to form the gun. Many of the componnents, and particularly the ratchet and pawl assemblies in such guns, have hitherto been fabricated from metals such as low grade steel. Accordingly, the ram guns previously available have been relatively heavy to handle and relatively expensive to produce because of the number of components required and the manual operations involved in the assembly of the guns. Such considerations have so far precluded the introduction of ram guns into the single use, disposable, throw-away market.

The present invention provides a ram gun dispenser of greatly simplified construction and light weight which can be fabricated inexpensively and which is especially adapted for the single use disposable market.

SUMMARY OF THE INVENTION

It is an object of the invention to provide a ram gun dispenser which is readily fabricated from light weight material. It is a further object of the invention to provide a ram gun dispenser fabricated from two components each of which can be integrally formed by molding from plastic material. It is yet another object of the invention to provide an inexpensive disposable ram gun dispenser.

These objects, and other objects which will become apparent from the detailed description which follows, are achieved by the ram gun dispensing device of the invention. The device in its broadest aspect comprises a housing for receiving fluid material to be dispensed and having a nozzle for dispensing the material from the housing. The housing has an integrally formed handle to which a trigger is attached pivotally but biased away therefrom. A pawl is attached to or integrally formed in the trigger. A ram is slidably mounted in the housing and provided on one external surface with a rack which is engaged by the pawl attached to the trigger. Manual squeezing of the trigger towards the handle actuates the ratchet formed by the pawl and rack and causes the ram to be advanced a desired increment into the housing thereby expelling a portion of the contents of the housing through the dispensing nozzle. Release of the squeezing pressure allows the pawl to be biased away from the trigger thus permitting the pawl to disengage from the cog in the rack which the squeezing pressure had caused the pawl to engage. Reapplication of squeezing pressure causes the pawl to re-engage the rack via a cog located one or more cogs behind the previously engaged cog. Repeated squeezing and release of the trigger serves to advance the ram by further increments until the desired amount of material has been dispensed through the nozzle.

All the components of the device are fabricated by molding from plastic material such as ABS, polypropylene, polyurethane, polyamides, and the like. Conventional techniques such as injection molding, reaction injection molding and the like, can be employed.

The ram is necessarily molded as a separate entity but, in a preferred embodiment, the remainder of the components are integrally molded in a single continuous piece in which the housing and handle are integrally formed, the trigger is attached to the handle by a relatively thin flexible strip of the plastic and the pawl is integrally formed as a resilient appendage to the trigger or, in a less preferred embodiment, is attached to the trigger by a second relatively thin flexible strip of the plastic. The two strips serve as living hinges as will be discussed more particularly below.

DESCRIPTION OF THE DRAWINGS

FIG. 6 is an exploded perspective view of another embodiment of a device according to the invention.

FIG. 7 is a partial perspective view of the trigger and pawl of the device shown in FIG. 6.

FIG. 8 is a perspective view, partially cutaway, showing the actuating mechanism of the device shown in FIG. 6.

FIG. 8A is an enlarged view of the circled portion in FIG. 8.

DETAILED DESCRIPTION OF THE INVENTION

Figure 1:
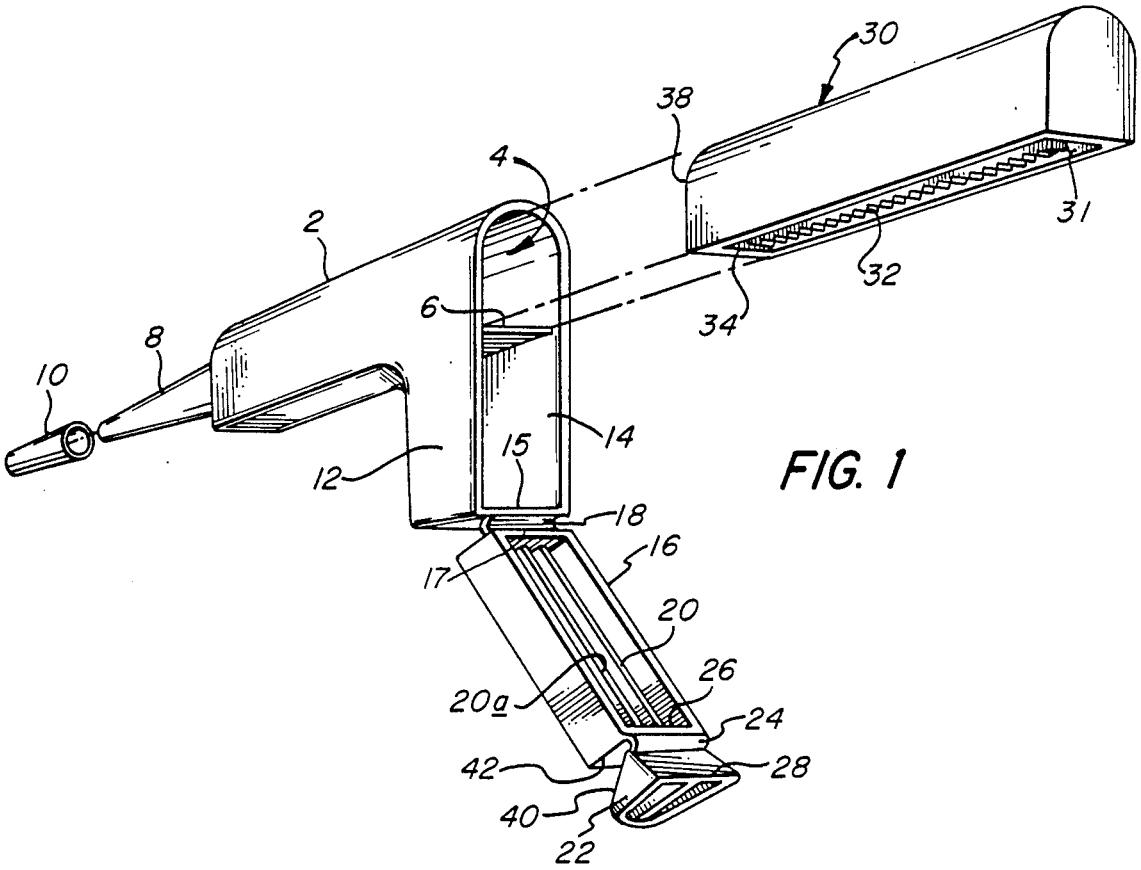
FIG. 1 is an exploded perspective view of a device according to the invention.

Referring to the drawings, the ram gun shown in FIG. 1 has a housing section, shown generally as 2, having a hollow interior 4 of uniform U-shaped cross-section with a planar floor 6 which extends substantially the whole length of the housing. The housing is provided with a nozzle 8 with detachable closure 10. Handle 12 is integrally formed on the housing 2 and has a hollow interior 14. Trigger 16 is attached by its edge 17 to the lower edge 15 of handle 12 via a "living hinge", i.e. a relatively thin flexible strip 18 of plastic which is integrally formed in the simultaneous molding of the housing, handle and trigger. The trigger 16 is provided with reinforcing ribs 20 and 20*a*. These ribs are an optional feature of the device of the invention. While two such ribs are illustrated in the embodiment shown in FIG. 1 it is to be understood that only one, or more than two, such ribs can be employed if desired. If desired, corresponding reinforcing ribs can also be provided in the interior 14 of handle 12.

Wedge-shaped pawl 22 is attached to the edge 26 of trigger 16 by a second living hinge 24 which is integrally formed during the simultaneous molding of the other components namely the housing 2, handle 12, trigger 16 and flexible strip 18. The pawl 22 is provided with a ratchet engaging tip 28 which lies in a plane parallel to those in which are disposed the edges 17 and 26 of the trigger 16 and the edge 15 of the handle 12.

Ram 30 has an elongated closed body of uniform Ushaped cross-section which corresponds to that of the hollow interior 4 of the housing 2 so that the surface of the ram 30 is in sliding engagement within the walls and floor 6 of the interior 4 when the ram is inserted therein. Rack 32 is integrally formed in a recess 31 in the planar underside 34 of ram 30, the recess being sufficiently deep so that none of the individual cogs in said rack 32 project below the plane of the underside 34.

Figure 2:
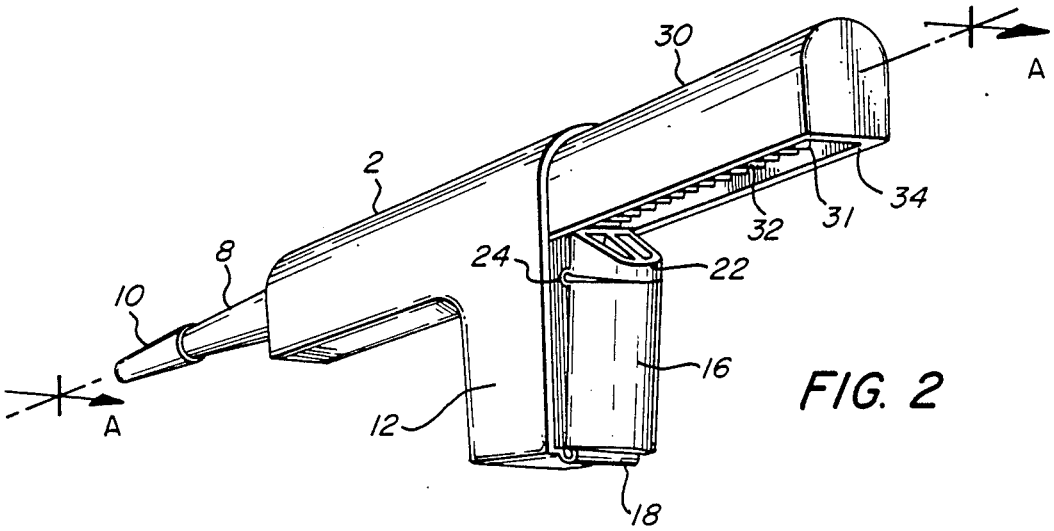
FIG. 2 is a perspective view of the device shown in FIG. 1 with the components assembled and in operative configuration.
Figure 4:
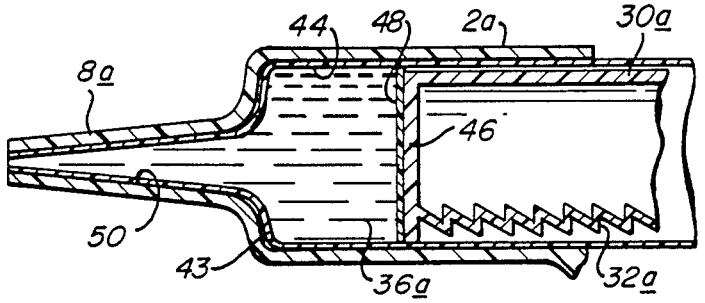
FIG. 4 is a partial cross-sectional view of an alternative embodiment of a device according to the invention.
Figure 3:
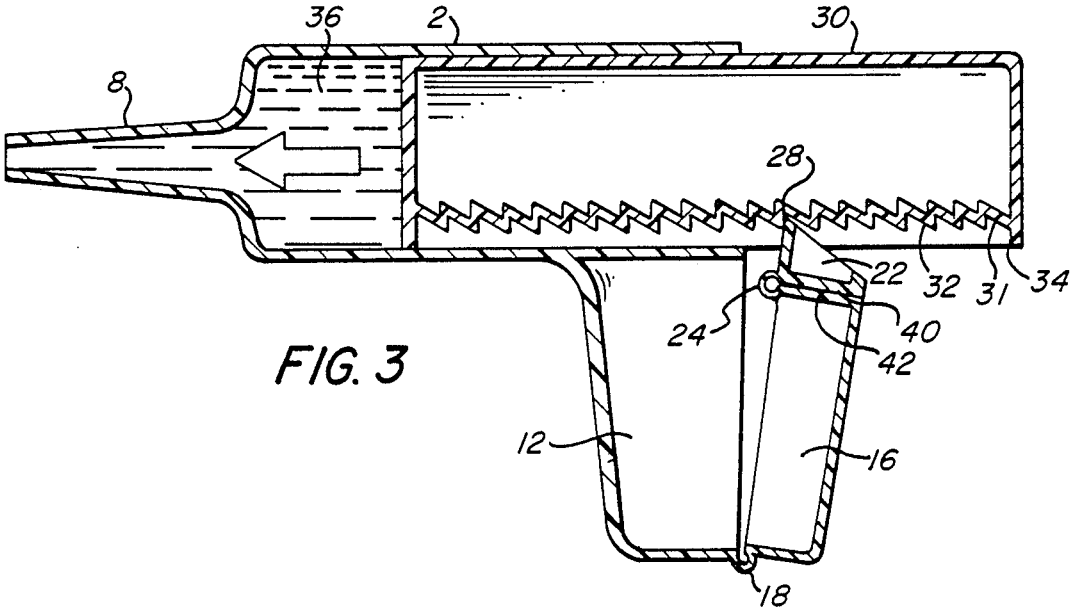
FIG. 3 is a cross-sectional view taken along the line A—A in FIG. 2.
Figure 5:
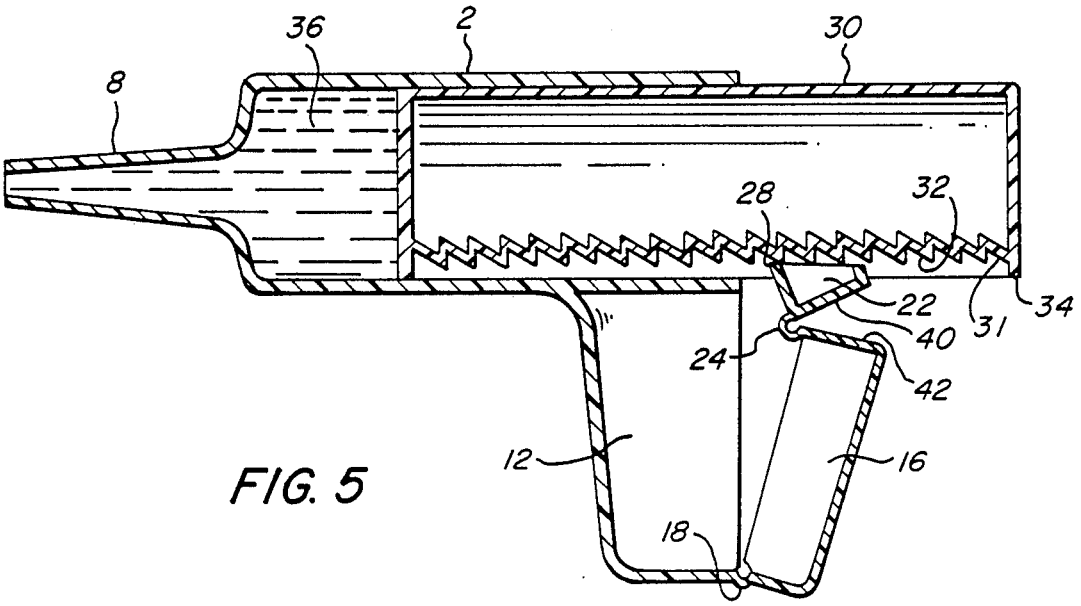
FIG. 5 is a modified cross-sectional view as shown in FIG. 3 but with the pawl and trigger in a non-actuating mode.

FIG. 2, and the cross-sectional views taken along the line A—A therein and shown in FIGS. 3 and 5, illustrate the method of assembly and interaction of the components shown in FIG. 1. The first step in the assembly comprises introducing into the interior 4 of housing 2, a charge 36 of the fluid material to be dispensed. Advantageously the charge 36 is introduced directly into the housing i.e. without being prepackaged in any form of container, as shown in FIG. 3, particularly where the ultimate device is to be employed as a single charge disposable ram gun. Where the ram gun in intended to be recharged after use, the charge of fluid material is introduced in a cartridge from which the fluid material can be expelled by force of the ram 30 as will be illustrated more particularly below in regard to FIG. 4.

Referring again to FIGS. 2 and 3, the charge 36 is introduced by any appropriate means in an amount such that the interior 4 of the housing 2 is not completely filled so as to leave room for insertion of the end 38 of ram 30 into the outer end of the interior 4. Thereafter the trigger 16 with attached pawl 22 is bent upwardly about the living hinge 18 so as to bring the trigger 16 into proximate engagement with the handle 12 and the tip 28 of pawl 22 into resting engagement with a cog in rack 32 of the ram 30 as shown in FIG. 3.

When the various components have been assembled in this manner the living hinges 18 and 24 have assumed the flexed curved configurations shown in FIG. 5. In such configuration the hinge 18 acts to bias the trigger 16 away from the handle 12 and the hinge 24 acts to bias the underside 40 of the pawl 22 away from engagement with the end 42 of the trigger 16 and towards the handle 12. In this position the pawl 22 is in sliding engagement with the rack 32 on the ram 30. However, when manual squeezing pressure is applied to overcome the bias action of hinge 18 and bring the trigger 16 towards touching engagement with the handle 12, the surfaces 40 and 42 on the pawl and trigger respectively are forced into contact against the bias of hinge 24 and the tip 28 of pawl 22 is forced into operating engagement with a cog in rack 32 as illustrated in FIG. 3. The ram 30 is thereby displaced incrementally into the interior 4 of housing 2 and an amount of charge 36 corresponding in volume to the volume displaced by movement of the ram 30 is discharged through nozzle 8. Release of the squeezing pressure allows the trigger 16 and pawl 22 to reassume the configuration shown in FIG. 5. Repeated squeezing together of the handle and trigger followed by release of the squeezing pressure causes the ram 30 to be displaced by increments further into the housing 2 in order to displace any desired amount of the fluid charge 36.

The partial cross-sectional view shown in FIG. 4 illustrates a modification of the device illustrated in FIGS. 1, 2, 3 and 5 to permit utilization of the device to dispense fluid material 36*a* from a cartridge container 43. In this embodiment the cartridge wall 44 is configured to be received in close fitting engagement with the interior walls of the container 2A and is provided with projection 50 which fits into the interior of nozzle 8*a*. The cartridge 43 is closed at its outer end with dish shaped seal 48 which is adapted to receive the head 46 of the ram 30*a*. Actuation of the ram 30*a* as described above displaces the ram 30*a* further into the housing 2*a* and, in turn, displaces the seal 48 into the body of the cartridge 43 thereby expelling a portion of the fluid charge therefrom.

Referring now to FIG. 6 there is shown a different embodiment of a ram gun in accordance with the invention in which housing 102 has an interior 104 with substantially uniform circular cross-section adapted to receive ram 130. The latter has rack 132 disposed longitudinally on the underside 134 thereof and supported by ribs 133 and 133*a* which define trough 135 between the inner facing edges of said ribs and which optionally have arcuately shaped outer surfaces 137. The rack 132 and ribs 133 and 133*a* are supported by, and project perpendicularly from, disc member 139 which has a cross-sectional diameter slightly less than that of the interior 104 of housing 102. A second disc member 141 is attached to, and spaced apart from, disc 139 in parallel coaxial relationship therewith by means of support members 147. Disc 141 is provided with flange 145 which has an exterior diameter approximating that of the interior 104 so that the periphery of flange 145 is in sliding, sealing engagement with the wall of interior 104 when said ram is inserted into the housing 102.

Handle 112 and trigger 116 are attached by living hinge 118 as in the previous embodiment discussed above but pawl 122, integrally formed in the upper end of trigger 116, is a resilient strip with reinforced tip 128 which is capable of limited flexing upwardly and rearwardly, with respect to the forward motion of the ram 130, when the trigger is squeezed to actuate the ram. The configuration of pawl 122 is shown in detail in FIG. 7 (non-actuated position) and flexed in the actuating position in FIG. 8. The ability of the pawl 122 to flex in the manner shown enables the tip 128 to disengage readily and completely from the rack 132 when the squeezing pressure is released from the trigger 116.

Hook members 152 project outwardly from the inner edges of trigger 116 and have sufficient resiliency to snap over and enter into sliding engagement with lug members 154 (only one side shown) appropriately located on the exterior wall of handle 112. As seen more particularly in FIG. 8 the elongated arm of hook 152 is in sliding engagement with lug 154 when the trigger is in the actuating position and the curved tip 156 of the hook is spaced apart from lug 154. When the squeezing pressure on trigger 116 is released the latter is biased pivotally away from handle 112 by the action of living hinge 118. However, the distance through which the trigger 116 can pivot in this manner is determined by the distance through which the tip 156 of the hook 152 can travel before it is arrested by engagement with lug 154.

The extent to which the trigger 116 can be squeezed towards handle 112 is controlled by the limiting effect provided by interaction of the leading edge 156 of stop member 158 and the outer edge of bar 160 which is mounted in handle 112 and projects outwardly from the interior thereof. The stop member 158 has a T-shaped cross-section and projects outwardly from the inner back wall of the trigger 116. The lengths of stop member 158 and/or corresponding bar 160 can be adjusted appropriately so as to arrest at any desired location the further movement of trigger 116 towards handle 112. As shown in FIGS. 6 and 8 the leading edge 157 of the vertical arm of T-shaped cross-sectional stop member 158 slopes downwardly and inwardly towards the interior of the trigger. It is to be understood that this particular configuration is not critical and said edge 157 can have a wide variety of profiles such as convexly or concavely curved without interfering with the mode of action of this component. Similarly, the leading edge of bar 160 can assume different profiles provided the interaction of this edge and edge 157 still provides the desired arresting action as the trigger 116 is squeezed towards handle 112.

A second bar 162 projecting outwardly from the interior of handle 112 and spaced above the bar 160 serves as a guide to prevent the horizontal cross-bar of member 158 from being deflected upwardly should the squeezing force urging trigger 116 towards handle 112 be so strong as to cause leading edge 157 to ride up over the front edge of projecting bar 160.

The housing 102, handle 112, hinge 118, trigger 116, and all attachments thereto shown in FIG. 6 can be molded in a single integral form from plastic as hereinbefore described. Similarly the ram 130 can also be integrally molded as the second component of the total assembly.

The embodiments described above have been shown for purposes of illustration only and are not to be construed as limiting the present invention. As will be obvious to one skilled in the art various modifications to the devices illustrated above can be made without departing from the invention. Thus the interior of the housing and the ram can have other cross-sections including square, rectangular, elliptical and the like. The ram and the interior of the housing can be provided with appropriate gasket means to ensure sealing engagement of the ram and housing particularly in the case in which the fluid material is charged directly to the container without prepackaging in cartridge form. The handle and the trigger can be in closed form rather than having open cavities are previously shown. Other such modifications will be readily apparent to one skilled in the art.

What is claimed is:

1. A ram gun for dispensing viscous fluid material comprising in combination:

a hollow housing adapted to receive fluid material to be dispensed;

nozzle means for dispensing material from said housing; ram means slidably mounted in said housing;

a ratchet rack disposed lengthwise on said ram means; a handle integral with said housing;

trigger means pivotally attached to the lower end of said handle;

means biasing said trigger means away from said handle in a direction away from said nozzle means;

pawl means disposed on said trigger means and adapted to engage said ratchet rack upon squeezing said trigger means against said handle; and means limiting the distance through which the trigger means is biased away from said handle.

2. A ram gun according to claim 1 which further includes stop means limiting the distance through which said trigger means can be moved towards said handle.

3. A ram gun according to claim 1 wherein said pawl is resiliently attached to said trigger means and is adapted to flex in a direction diametrically opposed to that in which said ram means is caused to move when said pawl engages said ratchet rack.

4. A ram gun according to claim 1 wherein said housing, said nozzle means, said handle, said trigger means, said pawl and said limiting means are all integrally molded as a single component from plastic and said ram means and ratchet rack are also integrally molded from plastic as a second component.

5. A ram gun according to claim 4 wherein said handle is attached to said trigger means by a living hinge.

6. A ram gun for dispensing viscous fluid material comprising in combination:

a hollow housing adapted to receive fluid material to be dispensed;

nozzle means for dispensing material from said housing;

ram means slidably mounted in said housing;

a ratchet rack disposed lengthwise on said ram means;

a handle integral with said housing;

trigger means pivotally attached to said handle;

means biasing said trigger means away from said handle in a direction away from said nozzle means;

pawl means disposed on said trigger means and adapted to engage said ratchet rack upon squeezing said trigger means against handle; and means limiting the distance through which the trigger means is biased away from said handle;

said limiting means comprising hook means disposed on one of said handle and said trigger means and slidably engaging lug means on the other of said handle and said trigger means.

7. A ram gun for dispensing viscous fluid material comprising in combination:

a housing adapted to receive fluid material to be dispensed;

nozzle means for dispensing material from said housing;

ram means slidably mounted in said housing;

a ratchet rack disposed lengthwise on said ram means;

a handle integral with said housing;

trigger means pivotally attached to said handle;

means biasing said trigger means away from said handle in a direction away from said nozzle means;

pawl means pivotally attached to said trigger means and adapted to engage said ratchet rack upon squeezing said trigger means against said handle; and means to bias said pawl away from said trigger in a direction opposite to that in which the trigger is biased away from said handle.

8. A disposable dispensing device adapted to dispense viscous fluid materials by extrusion through a nozzle said device comprising:

a hollow elongated barrel adapted to receive a charge of said fluid material and provided with nozzle means at one end thereof;

ram means slidably mounted in said barrel and having a ratchet rack disposed legnthwise along one surface thereof;

handle means integral with said barrel;

trigger means pivotally attached to said handle means and biased away therefrom by a living hinge;

a pawl attached to said trigger means;

said pawl adapted to engage said ratchet rack disposed on said ram means upon manual squeezing of said trigger means against said handle;

said dispensing device being further characterized in that said barrel, handle means, trigger means, pawl means and living hinge are integrally molded from plastic material as a first component and the ram with associated ratchet rack is integrally molded from plastic material as a second component.

9. A disposable dispensing device according to claim 8 which further includes means limiting the distance through which the trigger means is biased away from said handle.

10. A disposable dispensing device according to claim 9 which further includes stop means limiting the extent to which said trigger can be squeezed towards said handle.

11. A disposable dispensing device according to claim 8 wherein said pawl is resiliently attached to said trigger means and is adapted to flex in a direction diametrically opposed to that in which said ram means is caused to move when said pawl engages said ratchet rack.

12. A ram gun for dispensing viscous fluid materials comprising in combination:

a housing for receiving fluid material to be dispensed;

nozzle means for dispensing material from said housing;

ram means slidably mounted in said housing for forcing said material from said housing through said nozzle;

a ratchet rack disposed lengthwise along one surface of said ram means;

a handle mounted on said housing;

trigger means pivotally attached at one end thereof to said handle and having means biasing said trigger away from said handle in a direction away from said nozzle means;

a wedge-shaped pawl pivotally attached to the other end of said trigger;

means biasing said pawl away from the end of said trigger means and towards said handle and maintaining said pawl in sliding engagement with said ratchet rack on said ram means;

said pawl being adapted to engage a cog in said ratchet rack, when squeezing pressure sufficient to overcome the action of both of said biasing means is applied to force said trigger means against said handle, and to disengage said cog and return to sliding engagement with said ratchet rack when said squeezing pressure is released.

13. A ram gun according to claim 12 wherein the means biasing such trigger away from said handle and the means biasing said pawl away from said trigger means are living plastic hinges which also serve to pivotally attach said trigger to said handle and said pawl to said trigger.

* * * * *

UNITED STATES PATENT AND TRADEMARK OFFICE

CERTIFICATE OF CORRECTION

PATENT NO. : 4,744,494

DATED : May 17, 1988

INVENTOR(S) : Richard H. Seager; Philip B. Hinkle

It is certified that error appears in the above-identified patent and that said Letters Patent is hereby corrected as shown below:

Col. 1, line 16: "076,225" should be --3,076,225--;

Col. 1, line 27: "as" should be --a--.

Signed and Sealed this

Twelfth Day of March, 1991

*Attest:*

HARRY F. MANBECK, JR.

*Attesting Officer*

*Commissioner of Patents and Trademarks*